US012788130B2

(12) United States Patent
Winger et al.

(10) Patent No.: US 12,788,130 B2
(45) Date of Patent: Nov. 10, 2026

(54) BACKPACK WITH A CHILD SEAT SECURE DEVICE

(71) Applicant: HTS Hans Torgersen & Sønn AS, Krøderen (NO)

(72) Inventors: Julius Andreas Winger, Oslo (NO); Erlend Andreas Glømmen, Asker (NO)

(73) Assignee: HTS Hans Torgersen & Sønn AS, Krøderen (NO)

( * ) Notice: Subject to any disclaimer, the term of this patent is extended or adjusted under 35 U.S.C. 154(b) by 133 days.

(21) Appl. No.: 18/875,971

(22) PCT Filed: Jun. 20, 2023

(86) PCT No.: PCT/EP2023/066639

§ 371 (c)(1),
(2) Date: Dec. 17, 2024

(87) PCT Pub. No.: WO2023/247538

PCT Pub. Date: Dec. 28, 2023

(65) Prior Publication Data

US 2025/0375022 A1 Dec. 11, 2025

(30) Foreign Application Priority Data

Jun. 20, 2022 (NO) ..... 20220694

(51) Int. Cl.
*A45F 4/02* (2006.01)
*A47D 15/00* (2006.01)

(52) U.S. Cl.
CPC ..... *A45F 4/02* (2013.01); *A47D 15/006* (2013.01); *A45F 2004/026* (2013.01)

(58) Field of Classification Search
CPC ... A45F 2004/026; A45F 4/02; A47D 15/006; A47D 13/025

(Continued)

(56) References Cited

U.S. PATENT DOCUMENTS

D308,916 S * 7/1990 Dinham ..... D12/416
5,499,860 A * 3/1996 Smith ..... A47D 1/02 297/183.5

(Continued)

FOREIGN PATENT DOCUMENTS

CN 209628931 U 11/2019
CN 212521340 U 2/2021

(Continued)

OTHER PUBLICATIONS

European Patent Office, International Search Report and Written Opinion issued in International Patent Application No. PCT/EP2023/066639, mailed on May 10, 2023.

(Continued)

*Primary Examiner* — Scott T Mcnurlen
(74) *Attorney, Agent, or Firm* — Leydig, Voit & Mayer, Ltd.

(57) ABSTRACT

A backpack with an integrated child seat secure device for securing a child while seated in a chair is disclosed. The backpack comprises a compartment, a shoulder harness system, and a back support for supporting the back of a carrier person. The back support comprises a front cover and a back cover connected to the front cover, wherein the front cover and the back cover forms a space between each other for receiving a backrest of the chair. The child seat support device further comprises a leg strap connected to the front cover and arranged to be situated between the legs of the child, and two side straps, each with one end connected to the back cover and opposite end connectable to the leg strap, providing a three-point connection system such that the child is secured to the chair.

20 Claims, 4 Drawing Sheets

(58) Field of Classification Search
USPC ..... 297/188.04–188.7; 224/275, 155, 224/159–160
See application file for complete search history.

(56) References Cited

U.S. PATENT DOCUMENTS 5,573,155 A 11/1996 Sadler
5,894,977 A * 4/1999 Krueger ..... A45F 3/04 224/153
6,390,345 B1 * 5/2002 Brown ..... A45C 3/00 190/110
6,692,072 B2 * 2/2004 Nelson ..... A47D 15/006 297/250.1
7,073,866 B1 7/2006 Berdahl
8,678,253 B2 * 3/2014 Graham ..... A45F 3/047 224/644
2008/0302840 A1 * 12/2008 Missick ..... A47C 4/52 297/219.1
2013/0161366 A1 * 6/2013 Almoumen ..... A45F 3/04 224/576

FOREIGN PATENT DOCUMENTS

CN 215820085 U 2/2022
CN 216147438 U 4/2022

OTHER PUBLICATIONS

Norwegian Patent Office, Search Report issued in Norwegian Patent Application No. 20220694, mailed on Nov. 28, 2022.

* cited by examiner

BACKPACK WITH A CHILD SEAT SECURE DEVICE

CROSS-REFERENCES TO RELATED APPLICATIONS

This patent application is a National Stage of International Patent Application No. PCT/EP2023/066639, filed Jun. 20, 2023, which claims the benefit of Norwegian patent application No. 20220694, filed Jun. 20, 2022.

The present invention is related to a backpack with an integrated child seat secure device for securing a child while seated in a chair. The back support of the backpack comprises a front cover and a back cover creating a space between each other for receiving a backrest of the chair. The securing system comprises a leg strap connected to the front cover and arranged to be situated between the legs of the child, and two side straps connected to the back cover and connectable to the leg straps, providing a three-point connection system such that the child is secured to the chair.

BACKGROUND

There are many situations in everyday life of parents that the child or baby needs to be seated upright so that they can eat, play, or do other activities. Not always is a child chair available and the risk of injury by the child falling out of adult chairs are a big concern and often leads to parents carrying the child instead.

Document U.S. Pat. No. 7,073,866B1 discloses a safety harness to restrain young children, particularly toddlers, which are used to ensure that a child does not accidentally fall from a chair, highchair, shopping cart, stroller, etc. The safety harness fits over the shoulders and the back and chest of a child and is fitted with a detachable and adjustable strap with two Swivel Snap hooks and a D ring, three belt loops, and five additional D rings.

The harness system is complicated and requires the parents to bring the safety harness along when travelling. It also requires having an additional bag to carry the device along the trip.

An object of the present invention is to provide a child seat secure device that is easy to carry and use.

Another object of the present invention is to provide a carry device that parents can naturally and easy carry along the trip and has multiple use functions.

SUMMARY OF THE INVENTION

The present invention is directed to a carrying device which can be transformed into a child seat secure device.

A child seat secure device is a device that is adapted to fit onto a chair and used to ensure that a child does not accidentally fall from the chair.

In details, the present invention is directed to a backpack with an integrated child seat secure device for securing a child while seated in a chair. The backpack comprises a compartment, a shoulder harness system, and a back support for supporting the back of a carrier person. The carrier person may be parents or adult accompanying the child.

The back support comprises a front cover, and a back cover, wherein the front cover is a flap, a projecting or hanging piece attached to the upper end of the back cover. The flap and the back cover create a space between each other for receiving a backrest of the chair.

Throughout the application, the terms "front cover" and "flap" are used interchangeably and directed to the same feature.

Thus, the back support comprises a front cover and a back cover connected to the front cover, wherein the front cover and the back cover create or form a space between each other for receiving a backrest of the chair.

The backpack and the child seat secure device of the backpack, further comprises a leg strap connected to the front cover and arranged to be situated between the legs of the child, and two side straps connected to the back cover and connectable to the leg straps, providing a three-point connection system such that the child is secured to the chair.

Throughout the application, the terms "child seat secure device" and "child seat support device" are used interchangeably and are referred to the same device.

The backpack may also be referred to as a knapsack, schoolbag, rucksack, pack, back sack or other. In its simplest the backpack is frameless and comprises a compartment, connected to a back support, to be carried on one's back and secured with two straps that goes over the shoulders (shoulder harness). Within the scope of the invention, any backpack with or without frame, may be applicable.

The back support serves to support the pack and together with straps, distribute the weight of its contents across the body of the carrier.

The back support of the present comprises a front cover and a back cover.

The back support may thus be separated into the front cover and back cover. The back cover may be fixed to the backpack compartment so that the compartment and back cover constitute one unit. The front cover may be connected to an upper part of the backpack or upper part of the front cover, such as a flap.

The front cover is a flap, a projecting or hanging piece attached to the upper end of the back cover. The opposite free end of the flap projects freely or hangs loose. Thus, the free and open end of the flap is directed downwards from the highest point of the flap which is the point of attachment onto the back cover.

Furthermore, the flap may be directly attached to the back cover such that the point of attachment creates a fold, the fold is a separation area that separates the front cover from the back cover. Thus, the folded ends comprise the font cover and the back cover, the two covers providing a space, cavity, compartment, gap or opening for receiving the backrest of a chair. The top section of the backrest may preferably abut against the inside of the fold for distributing the weight of the backpack onto the chair.

In use as a backpack, the front cover is connected to the back cover such that mainly the front cover is visible and facing the back of the user. In use as a child seat securing device, the front cover is partly separated from the back cover (the free end of the flap is opened) to provide a space for receiving the backrest of the chair.

The front cover may be fixedly attached or connected to the back cover at the top ends, creating a fold, and such that the front cover and the back cover is arranged next to each other, side by side with their wide surface facing each other. The wide facing surfaces of the first and second covers, creates a space between each other, and the space being closed (sealed off) at the top to abut against the top end of the backrest of the chair. The space may also refer to a pocket, cavity, compartment, gap or opening.

The back support may comprise a closing arrangement for attaching the front cover to the back cover and for closing the space between the covers. The front and back covers may have substantially same shape such that they can be connected at their perimeters at the sides and/or bottom.

The front cover may be attached to the back cover by at least any one of a closing arrangement, such as a zipper, Velcro closure, snap lock, etc.

The back support may be operable between a carrying position in which the space is closed off, and a seat secure position in which the space is open so that it can receive the backrest of the chair for use as a child seat support device.

The leg strap is connected to the front cover and arranged to be situated between the legs of the child. It may be Y-shaped strap with three connection points, one in the centre fixed to the bottom end of the front cover and two at the upper sides adapted to be connected to the side straps. Each of the attachment points may be adjustable for securing and easy adjustment.

The two side straps are connected to the back cover at each side of the backpack. They are adapted to be secured around the sides of the chair backrest and tightened to the upper sides connection point of the leg strap, providing a three-point connection system for securing the child to the chair. The side straps and the leg strap may be adjustable straps comprising one or more adjustable buckles.

In the carrying position, when the backpack is used as a carrying device, the leg strap and the side straps may be folded into the space between the front and back cover and closed off by the closing arrangement. In this stored position, the leg strap and the side straps are folded away so that they are not visible and, in the way, when using the backpack as a carry device.

In the seat secure position, the top of the front and back cover may be folded over a top of the backrest of the chair so that the front cover is located at a front side of the chair, and the back cover is located at the back side of the chair, wherein a child is positioned onto the front cover with the leg straps between the legs and the child is secured by connecting the side straps to the legs straps.

The backpacks shoulder harness comprises two shoulder straps for fitting onto the shoulder of the carrier person. The shoulder straps are adjustable in a traditional manner by straps and buckles. However, the shoulder straps according to the present invention are attached at its upper end to the fold between the front and back cover, and at its lower end to the back cover. Or the straps may be attached to at least the back cover at the upper end and to the back cover at the lower ends, to that it overlaps at least a section of the front cover. The straps may extend at least from the fold and across the front cover and towards the lower and of the backpack at the lower end of the back cover. This provides a securing device for tightly securing the backpack to the backrest of the chair when the backpack is used as a child seat secure device, by adjusting the shoulder strap and strapping the backpack to the chair. In other words, the backrest of the chair is sandwiched between the front and back cover and secured by tightening the adjusting mechanism on the shoulder straps.

The invention is also directed to a method of securing a child to a chair by means of a backpack according to the embodiments described above. The method comprises the step of:

i) opening the closing arrangement so that the front cover is partly separated from the back cover and such that the space is revealed,
ii) deploying the back support onto the backrest of the chair so that the backrest is received into the space,
iii) bringing the two side straps and the leg strap in position,
iv) placing the child onto the front cover so that the leg strap is situated between the legs of the child,
v) securing the side straps around the sides of the backrest to the leg strap for providing a three-point connection,
vi) adjusting the side straps and/or the leg strap for tight and secure fit.

Further objects, structural embodiments and advantages of the present invention will be seen clearly from the following detailed description, the attached figures, and the claims below.

FIGURES

The invention will now be described with reference to the attached figures, wherein.

DETAILED DESCRIPTION OF THE FIGURES

In the following, exemplified embodiments of the invention will be discussed in detail with reference to the appended figures. It should be understood, however, that the figures are not intended to limit the invention to the subject-matter depicted in the figures.

Figure 1:
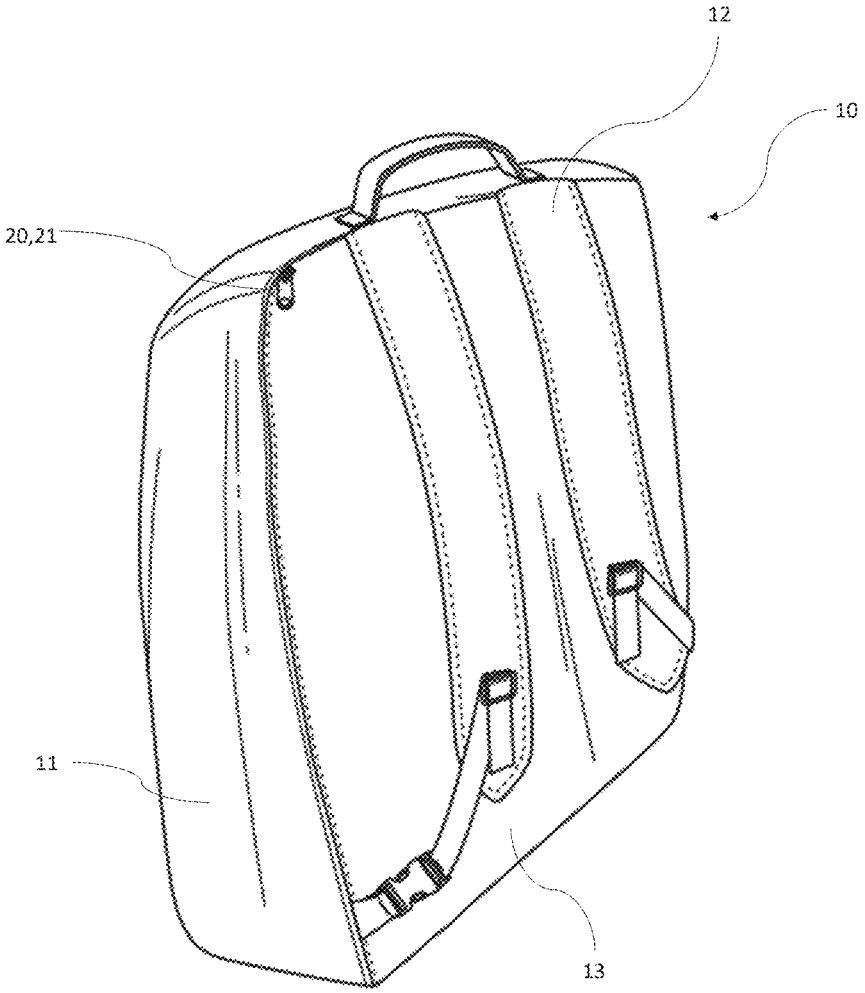
FIG. 1 shows a backpack comprising a comprises a compartment, a shoulder harness system with two shoulder straps, and a back support.

FIG. 1 shows a backpack 10 according to one embodiment of the present invention. The backpack 10 comprises a compartment 11 for carrying necessities, a shoulder harness system 12 comprising shoulder straps for carrying the backpack 10 onto the shoulders, and a back support 13 adapted to support the back of the carrier person. The back support 13 comprises a closing arrangement 20 for connecting or separating the front cover 14 from the back cover 15 and for closing or opening of the space 16 between the covers 14,15. The FIG. 1 shows the closing/locking arrangement as a zipper 21 provided at a perimeter of the front and back cover 14,15.

Figure 2:
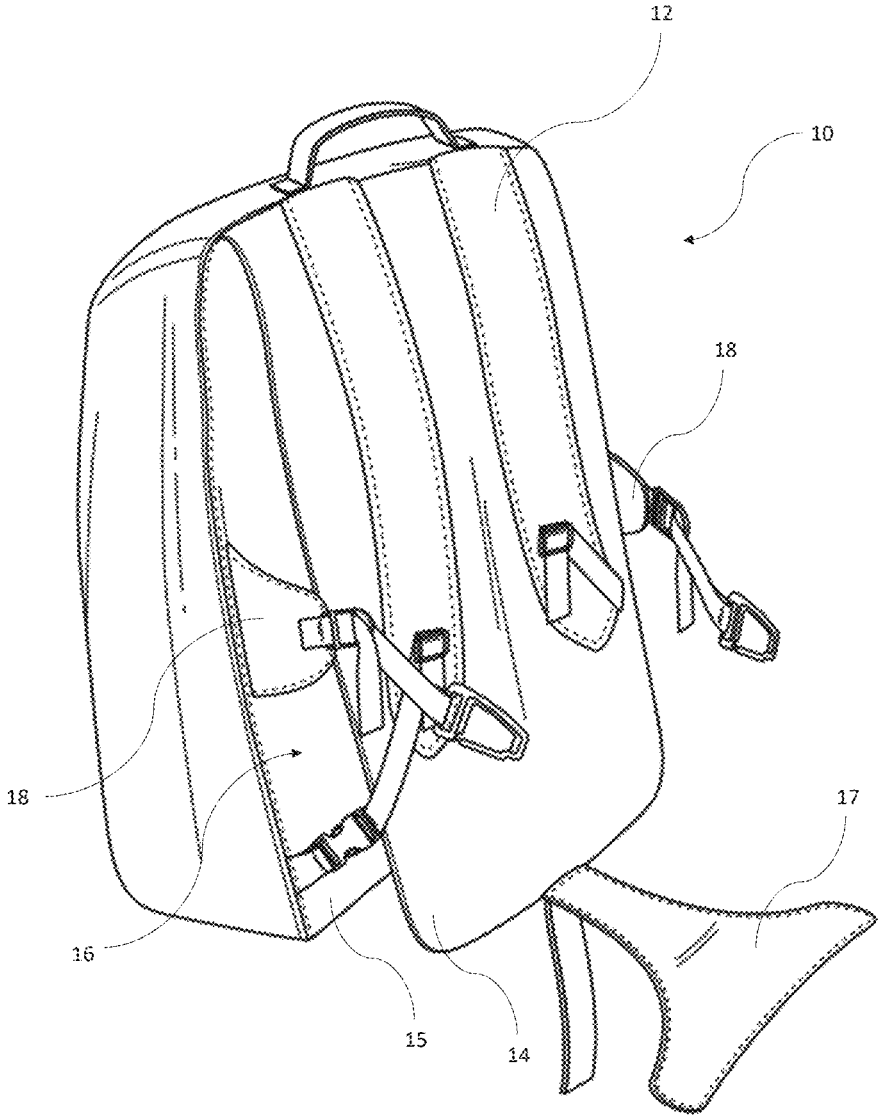
FIG. 2 shows a back support comprising a front cover and a back cover connected to the front cover providing a space between the covers.

FIG. 2 shows that the front cover 14 is a flap, a projecting or hanging piece attached to the upper end of the back cover 15. The flap 14 and the back cover 15 creates a space between each other for receiving a backrest of the chair 31. The flap 14 may have same size and dimension as the back cover 15, so that it fits to a footprint of the back cover 15, and the opening of the flap is directed downwards. The free- and open end of the flap 14 may be closed by a closing arrangement 20, such as a zipper 21.

FIG. 2 shows the backpack 10 and the back support 13, wherein the zipper 21 of the back support 13 is in the open position so that the front cover 14 is separated from the back cover 15. The front cover 14 is connected to the back cover 15 at a top end of the covers 14,15 such that a space 16 is provided between the covers 14,15. The covers 14,15 being arranged next to each other and comprises complementary closing/locking arrangements.

The back support 13 is operable between a carrying position in which the space 16 is closed off by the closing arrangement 20 (zipper 21), and a child seat secure position in which the space 16 is open such that it can receive the backrest 32 of the chair 31.

The child seat support device further comprises a leg strap 17 connected to the front cover 14 and arranged to be situated between the legs of the child 30 (see FIG. 4), and two side straps 18, each with one end connected to the back cover 15 and opposite end connectable to the leg strap 17, providing a three-point connection system such that the child 30 is secured to the chair 31. The leg strap 17 and the side straps 18 are foldable into the space 16 in the carrying position so that they are folded away while not in use and are not in the way.

Figure 3:
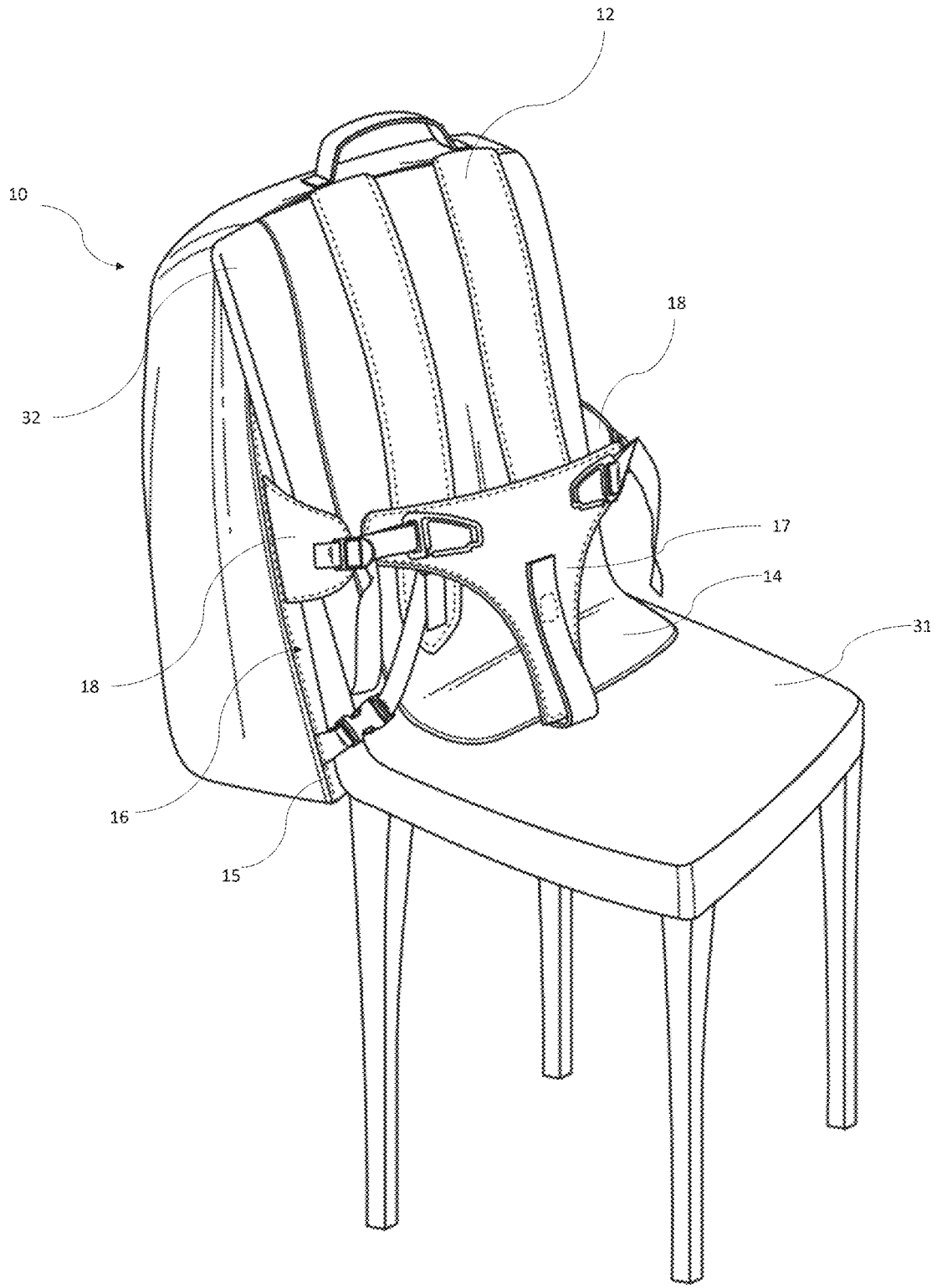
FIG. 3 shows the backpack mounted on a chair and with the backrest of the chair received into the space between the front and back covers.

FIG. 3 shows the backpack 10 positioned onto a chair 31, the child seat support device partly enclosing a backrest 32 of the chair 31. The back seat support 13 is in the child seat secure position so that at least a section of the backrest 32 is received into the space 16.

The adjustable leg strap 17 is Y-shaped and has three connection points, one in the bottom centre connected to the bottom end of the front cover 14, and two at the upper sides adapted to be connectable to the two side straps 18. The side straps 18 and the leg straps 17 may be adjustable for tight fit around and supporting the hip and waist of the child 30.

The backpack 10 further comprises a shoulder harness comprising two shoulder straps 12 for fitting onto the shoulder of the carrier person. The shoulder straps 12 are adjustable in a traditional manner by straps and buckles as shown in the FIGS. 2 and 3 and attached at its upper end to the fold between the front and back cover 14,15, and at its lower end to the back cover 15. It extends from the fold and across the front surface of the front cover 14 and towards the lower and of the backpack 10 at the lower end of the back cover 15. The shoulder straps 12 may therefore be used as a securing means for securing and tightening the backpack 10 to the backrest of the chair 31 when used as a child seat support device. The shoulder straps 12 provides a securing device for tightly securing the backpack 10 to the backrest of the chair 31, by adjusting the shoulder strap 12 adjustment system for strapping the backpack 10 to the chair 31.

The backpack 10 may further comprise a hip belt, an adjustable hip tightening belt for distributing the backpack carrying weight onto the hips of the carrier person. The hip belt (not shown in figures) may also be used as a securing means for securing and tightening the backpack 10 to the backrest of the chair 31 when used as a child seat support device. It may be located adjacent the lower end of the shoulder straps 12 and in use secured around (encircling) the front surface of the front cover 14 for securing the back support 13 to the chair 31.

Figure 4:
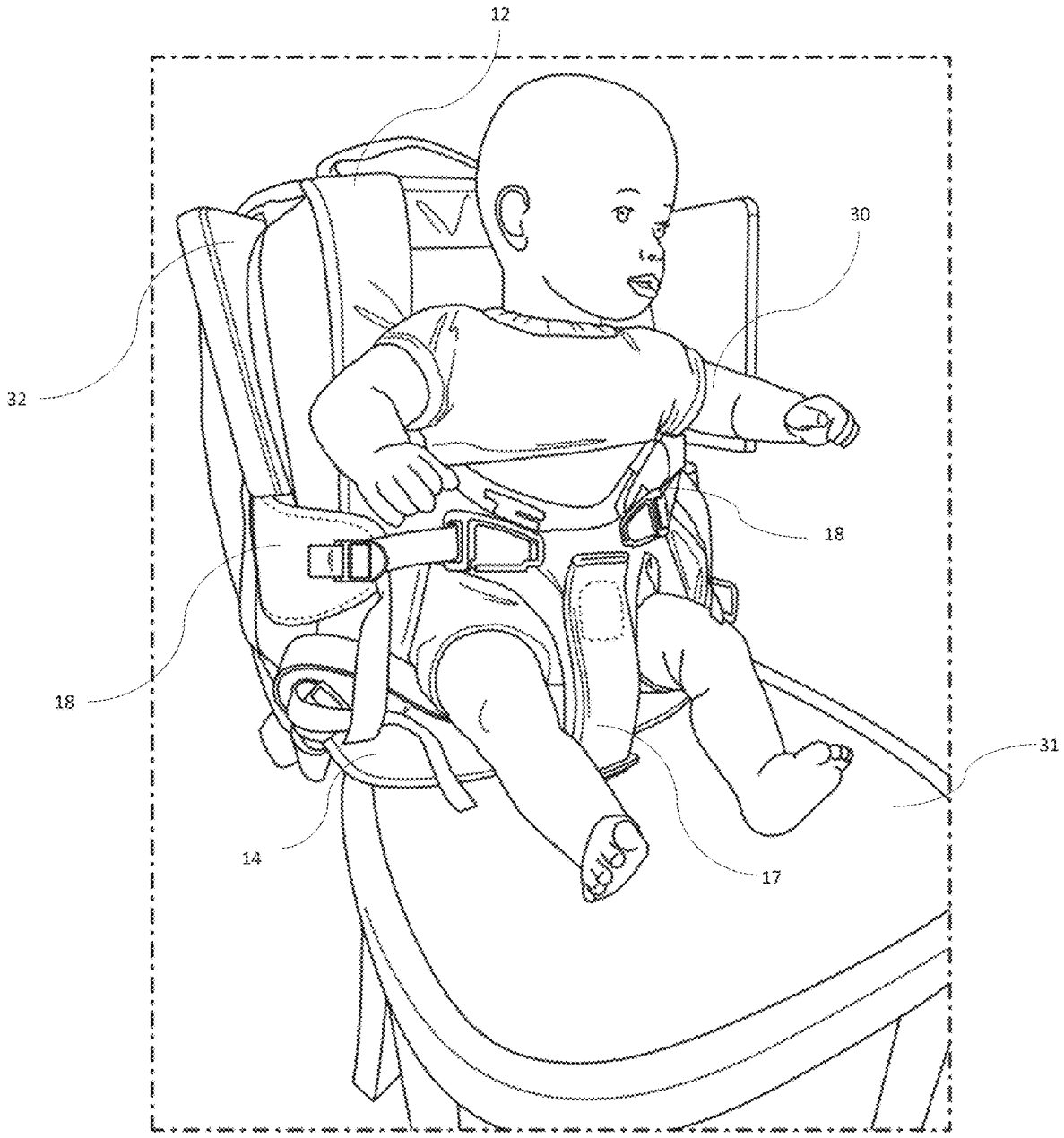
FIG. 4 shows a child positioned on a chair and secured by the child seat secure device of the backpack.

FIG. 4 shows a child 30 positioned into the child seat support device of the backpack 10. The leg strap 17 is located between the legs of the child 30 and adjusted by tensioning the bottom end of the leg strap 17. The side straps 18 are connected to the upper part of the leg strap 17 and secured and tightened by adjusting the buckle on the side straps 18.

In the child seat secure position as shown in FIG. 4, the front cover 14 is folded over a top of the backrest 32 of the chair 31 so that the front cover 14 is located at a front side of the chair 31 and the child 30 sitting on a lower section of the front cover 14, and the back cover 15 is located at the back side of the chair 31. The compartment 11 of the backpack 10 are easily accessible at the back of the chair.

The backpack 10 of the present invention provides a flexible device that can be used both as a backpack 10 and a child seat secure device if needed. When not in use as a child seat secure device the straps 16,17 are easily folded away into the gap 16 and closed off, so that they are not visible or get tangled up.

The invention claimed is:

1. A backpack with an integrated child seat secure device for securing a child while seated in a chair, wherein the backpack comprises a compartment, a shoulder harness system, and a back support for supporting the back of a carrier person, wherein the back support comprises a front cover and a back cover, wherein the front cover is a flap, a projecting or hanging piece attached to an upper end of the back cover, and wherein the flap and the back cover creates a space between the flap and the back cover for receiving a backrest of the chair, wherein the backpack further comprises:

a leg strap connected to the flap and arranged to be situated between the legs of the child, and two side straps, each of the two side straps with one end connected to the back cover and an opposite end connectable to the leg strap, providing a three-point connection system for the child to be secured to the chair.

2. The backpack according to claim 1, wherein the flap is attached to a top end of the back cover, creating a fold, so that the flap and the back cover are arranged next to each other, side by side, each with their a wide surface facing each other, and wherein an inside of the fold is adapted to abut against a top section of a backrest of the chair.

3. The backpack according to claim 2, wherein the back support comprises a closing arrangement for closing off the space between the front cover and the back cover.

4. The backpack according to claim 3, wherein the closing arrangement is a zipper provided at a perimeter of the flap and back cover.

5. The backpack according to claim 2, wherein the leg strap is a Y-shaped strap with three connection points, one at a bottom center of the leg strap connected to a bottom end of the flap and two at the upper sides of the leg strap adapted to be connectable to the two side straps.

6. The backpack according to claim 2, wherein the shoulder harness system comprises two shoulder straps and wherein the two shoulder straps are connected to the back cover and/or the flap at an upper end of each of the two shoulder straps and to the back cover at a lower end of each of the two shoulder straps.

7. The backpack according to claim 1, wherein the back support comprises a closing arrangement for closing off the space between the front cover and the back cover.

8. The backpack according to claim 7, wherein the closing arrangement is a zipper provided at a perimeter of the flap and back cover.

9. The backpack according to claim 8, wherein the back support is operable between a carrying position in which the space is closed off by the closing arrangement, and a child seat secure position in which the space is open such that the space can receive the backrest of the chair.

10. The backpack according to claim 9, wherein in the carrying position, the leg strap and the two side straps are folded and closed inside the space.

11. The backpack according to claim 7, wherein the back support is operable between a carrying position in which the space is closed off by the closing arrangement, and a child seat secure position in which the space is open such that the space can receive the backrest of the chair.

12. The backpack according to claim 11, wherein in the carrying position, the leg strap and the two side straps are folded and closed inside the space.

13. The backpack according to claim 12, wherein in the child seat secure position, the flap and the back cover are located on either side of the backrest of the chair, the flap located on a front side of the chair and the back cover is located on a back side of the chair, wherein the child is positioned onto the flap with the leg strap between the legs and the child is secured by connecting the two side straps to the leg strap.

14. The backpack according to claim 11, wherein in the child seat secure position, the flap and the back cover are located on either side of the backrest of the chair, the flap located on a front side of the chair and the back cover is located on a back side of the chair, wherein the child is positioned onto the flap with the leg strap between the legs and the child is secured by connecting the two side straps to the leg strap.

15. The backpack according to claim 7, wherein the shoulder harness system comprises two shoulder straps and wherein the two shoulder straps are connected to the back cover and/or the flap at an upper end of each of the two shoulder straps and to the back cover at a lower end of each of the two shoulder straps.

16. The backpack according to claim 1, wherein the leg strap is a Y-shaped strap with three connection points, one at a bottom center of the leg strap connected to a bottom end of the flap and two at the upper sides of the leg strap adapted to be connectable to the two side straps.

17. The backpack according to claim 16, wherein the back support is operable between a carrying position in which the space is closed off by a closing arrangement, and a child seat secure position in which the space is open such that the space can receive the backrest of the chair.

18. The backpack according to claim 1, wherein the shoulder harness system comprises two shoulder straps and wherein the two shoulder straps are connected to the back cover and/or the flap at an upper end of each of the two shoulder straps and to the back cover at a lower end of each of the two shoulder straps.

19. A method of securing a child to a chair by a backpack according to claim 1, wherein the method comprises:

opening a closing arrangement so that the flap is partly separated from the back cover and such that the space is revealed, deploying the back support onto the backrest of the chair so that the backrest is received into the space, bringing the two side straps and the leg strap in position, placing the child onto the flap so that the leg strap is situated between the legs of the child, securing the side straps around the sides of the backrest to the leg strap for providing a three-point connection, adjusting the side straps and/or the leg strap for tight and secure fit.

20. A method of securing a child to a chair by a backpack according to claim 2, wherein the method comprises:

opening a closing arrangement so that the flap is partly separated from the back cover and such that the space is revealed, deploying the back support onto the backrest of the chair so that the backrest is received into the space, bringing the two side straps and the leg strap in position, placing the child onto the flap so that the leg strap is situated between the legs of the child, securing the side straps around the sides of the backrest to the leg strap for providing a three-point connection, adjusting the side straps and/or the leg strap for tight and secure fit.

* * * * *